US009182726B2

(12) United States Patent
Endo

(10) Patent No.: US 9,182,726 B2
(45) Date of Patent: Nov. 10, 2015

(54) SHEET PROCESSING APPARATUS

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Katsuya Endo, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/097,645

(22) Filed: Dec. 5, 2013

(65) Prior Publication Data

US 2014/0193183 A1 Jul. 10, 2014

(30) Foreign Application Priority Data

Jan. 8, 2013 (JP) ..... 2013-001284

(51) Int. Cl.
*G03G 15/20* (2006.01)
*G03G 21/00* (2006.01)

(52) U.S. Cl.
CPC ..... *G03G 21/00* (2013.01)

(58) Field of Classification Search
CPC ..... G03G 15/36; G03G 21/00
USPC ..... 399/341
See application file for complete search history.

(56) References Cited

U.S. PATENT DOCUMENTS

2008/0232827 A1 9/2008 Yamaguchi et al.
2011/0222131 A1* 9/2011 Yahata et al. ..... 358/452
2011/0305851 A1* 12/2011 Wang et al. ..... 428/32.31

FOREIGN PATENT DOCUMENTS

JP 2005-301120 10/2005
JP 2008-233914 10/2008
JP 2009-280340 12/2009
JP 2010-100044 5/2010
JP 2011-191762 9/2011

OTHER PUBLICATIONS

Office Action of Notification of Reasons for Rejection for Japanese Patent Application No. 2013-001284 Dated Dec. 2, 2014, 10 pages.

* cited by examiner

*Primary Examiner* — David Gray
*Assistant Examiner* — Thomas Giampaolo, II
(74) *Attorney, Agent, or Firm* — Amin, Turocy & Watson, LLP

(57) ABSTRACT

According to an embodiment, a sheet processing apparatus having a function to erase an image formed on a sheet is provided. The sheet processing apparatus has a tray, an erasing unit and a control unit. The tray houses a sheet on which an image is formed. The erasing unit erases the image formed on the sheet. The control unit controls the erasing unit so that the image formed on the sheet is erased, when an elapsed time after the tray houses the sheet exceeds a predetermined threshold value.

2 Claims, 3 Drawing Sheets

SHEET PROCESSING APPARATUS

CROSS-REFERENCE TO RELATED APPLICATION

This application is based upon and claims the benefit of priority from the prior Japanese Patent Application No. 2013-1284, filed on Jan. 8, 2013, the entire contents of which are incorporated herein by reference.

FIELD

Embodiments described herein generally relate to a sheet processing apparatus having a function to erase an image formed on a sheet.

BACKGROUND

Recently, consciousness of a user about security has been enhanced. Accordingly, the trend has been increased wherein a user regards it a question that a sheet on which an image is formed by an image forming apparatus such as a copier and a printer is left in the image forming apparatus.

On the other hand, from the view point of resource saving, an image forming apparatus which forms an image on a sheet using erasable coloring material and erases the image of the sheet has been developed. After the sheet which a user has formed an image using the image forming apparatus becomes unnecessary, in order to reuse the sheet, a user can erase the image of the sheet by an erasing unit of the above-described image forming apparatus.

Furthermore, when it is determined that a security mark indicating that the sheet is a confidential document is formed on the sheet in the above-described image forming apparatus, the technology to erase the image of the sheet and dispose the sheet without reusing the sheet has been developed.

However, even with the above-described technology, the effect of countermeasure to the leaving of a sheet outputted from the image forming apparatus is insufficient.

DETAILED DESCRIPTION

Figure 1:
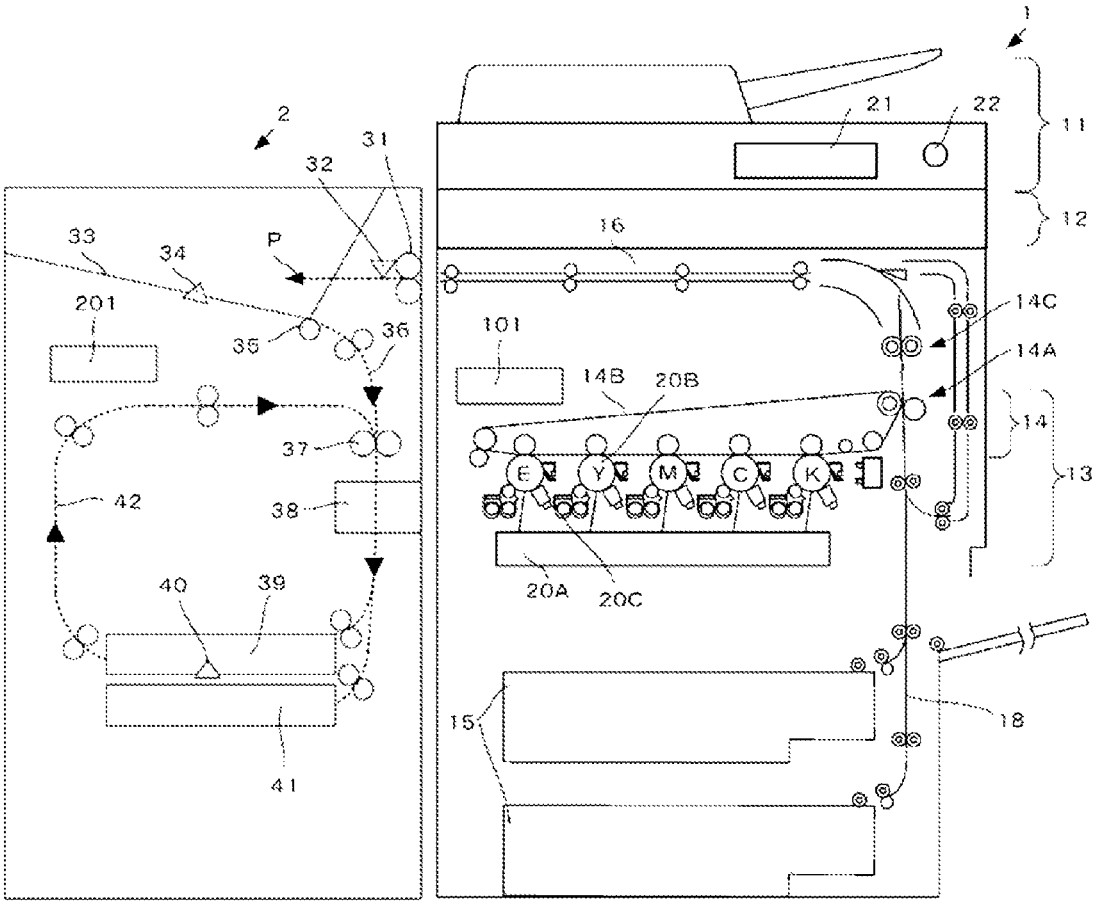
FIG. 1 is a sectional view showing a main portion of a sheet processing apparatus according to a first embodiment and an image forming apparatus which is used with the sheet processing apparatus.

According to an embodiment, a sheet processing apparatus having a function to erase an image formed on a sheet is provided. The sheet processing apparatus has a tray, an erasing unit and a control unit. The tray houses a sheet on which an image is formed. The erasing unit erases the image formed on the sheet. The control unit controls the erasing unit so that the image formed on the sheet is erased, when an elapsed time after the tray houses the sheet exceeds a predetermined threshold value.

Hereinafter, further embodiments will be described with reference to the drawings. In the drawings, the same symbols show the same or similar portions.

A first embodiment will be described with reference to FIG. 1. FIG. 1 is a sectional view showing a main portion of a sheet processing apparatus 2 according to the first embodiment and an image forming apparatus 1 which is used with the sheet processing apparatus 2.

As shown in FIG. 1, the image forming apparatus 1 has a control unit 101 of the image forming apparatus 1, an operation panel 21, a start button 22, an automatic document feeder 11, a scanner 12, an image forming unit 13, a transfer unit 14, a sheet conveying path 18, and a sheet feeding unit 15.

The operation panel 21 is provided with a touch panel that is an input/output unit to display a graphical user interface, for example.

Upon accepting a user's operation, the start button 22 transmits a signal for starting image forming to the control unit 101 of the image forming apparatus 1.

The automatic document feeder 11 is provided openably and closably at the upper portion of the main body of the image forming apparatus 1. The automatic document feeder 11 has a document conveying mechanism which takes out documents one by one from a sheet feeding tray, and conveys the document to a sheet discharge tray through a document reading position of the scanner 12.

The automatic document feeder 11 conveys the documents one by one to the document reading position of the scanner 12 by the document conveying mechanism, so as to make the above-described scanner 12 read an image of the document. In addition, the user can also open the automatic document feeder 11 and load a document on a document table of the scanner 12, so as to make the above-described scanner 12 read an image of the document.

The scanner 12 has an exposure lamp to expose a document, a carriage provided with a first reflection mirror, a plurality of second reflection mirrors which move in accordance with the movement of the carriage, a lens block, and a CCD (Charge Coupled Device) that is an image reading sensor.

The carriage stands still at the document reading position or reciprocates under the document table, to reflect the reflected light from the document to the first reflection mirror. The plurality of the second reflection mirrors reflect the reflected light from the first reflection mirror to the lens block. The lens block changes the magnification of the reflected light from the first reflection mirror, to lead the reflected light to the CCD. The CCD converts the incident light from the lens block into an electrical signal, and outputs the electrical signal to the image forming unit 13 as an image signal.

The image forming unit 13 has a laser irradiation unit 20A, a photoconductor drum 20B that is an image carrier, and a developer cartridge to house developer, for each of yellow Y, magenta M, cyan C, black K developers and erasable developer E. The developer cartridge is detachably provided in the image forming apparatus 1. The image forming unit 13 has further developer supply units 20C to supply the developers to the respective photoconductor drums 20B, and the transfer unit 14.

The erasable developer E includes a color developing compound, color developer, and decoloring agent. As the color developing compound, leuco dye can be quoted, for example. As the color developer, phenols are quoted, for example. As the decoloring agent, material that is compatible with the color developing compound when heated, and does not have affinity with the color developer, can be quoted.

The decolorable developer generates color by mutual interaction of the color developing compound and the color developer, and since the mutual interaction of the color developing compound and the color developer is cut when heated at not less than the erasing temperature, the erasable developer is decolored.

The laser irradiation unit 20A irradiates the photoconductor drum 20B with laser light, based on the above-described image signal from the scanner 12, to form an electrostatic latent image on the photoconductor drum 20B. The developer supply unit 20C supplies the developer to the photoconductor drum 20B, to form a developer image from the electrostatic latent image.

The sheet feeding unit 15 takes out sheets one by one from the sheet feeding cassette, to deliver the sheet to the sheet conveying path 18. The sheet conveying path 18 conveys the sheet to the transfer unit 14.

The transfer unit 14 has a transfer belt 14B and a transfer roller 14A. The developer image of the photoconductor drum 20B is transferred to the transfer belt 14B, which carries the developer image. A transfer voltage is applied to the transfer roller, and thereby the transfer roller transfers the developer image of the transfer belt to the sheet which has been conveyed.

The image forming apparatus 1 has a fixing device 14C provided at a more downstream position than the fixing unit 14 in the sheet conveying direction. The fixing device 14C heats and pressurizes the developer image, to fix it on the sheet.

The sheet P which has been discharged from a sheet discharge port of the image forming apparatus 1 is conveyed to the sheet processing apparatus 2 by a discharge mechanism 16.

The sheet processing apparatus 2 has an entrance roller 31 to receive the sheet from the discharge mechanism 16, an entrance sensor 32 provided adjacent to the entrance roller 31, and a tray 33 to house the sheet received by the entrance roller 31 in the loaded state. The sheet processing apparatus 2 further has a pickup roller 35 to take out a sheet from the tray 33, an erasing unit 37 to erase an image on a sheet by heating the sheet at not less than a erasing temperature, and a control unit 201.

The erasing unit 37 has a pair of rollers and a heater. The heater heats the surfaces of the pair of rollers. The heater may be provided inside the roller, or may be provided outside the roller. The heater may be provided at one of the pair of rollers, or the heaters may be provided at the both rollers. The heater may be a heater lamp, or may be an IH (Induction Heating) heater, for example. The pair of rollers convey a sheet interposed therebetween. The pair of rollers are heated by the above-described heater, to heat erasable coloring material forming an image of a sheet at not less than a prescribed erasing temperature. A heating temperature of the above-described heater is controlled by the control unit 201 so that the temperature of the erasable coloring material becomes not less than the above-described prescribed erasing temperature. The erasable coloring material is decolored as described below when heated at not less than the above-described prescribed temperature. Accordingly, the erasing unit 37 decolors the erasable coloring material, to erase the image of the sheet.

The erasable coloring material is the erasable developer E, for example. The erasable coloring material includes a color developing compound, color developer, and decoloring agent, for example. As the color developing compound, leuco dye can be used, for example. As the color developer, phenols can be used, for example. As the decoloring agent, material can be used which is compatible with the color developing compound when heated and does not have affinity with the color developer. The erasable coloring material generates color by mutual interaction of the color developing compound and the color developer, and since the mutual interaction of the color developing compound and the color developer is cut when heated at not less than the erasing temperature, the erasable coloring material is decolored.

The sheet processing apparatus 2 further has a first conveying mechanism 36 to convey a sheet from the tray 33 to the erasing unit 37, a punch unit 38 to perform punch processing to a sheet, a storage box 39 to store a sheet which has been left by a user, and a discharge tray 41 to house a sheet subjected to the punch processing in the loaded state.

The sheet processing apparatus 2 may have a staple unit to staple sheets in place of the punch unit 38, or along with the punch unit 38.

In the following description, the punch unit 38 and the staple unit are collectively referred to as a sheet processing unit 203.

The entrance sensor 32 detects enter of a sheet into the sheet processing apparatus 2. Upon detecting the intrusion of the sheet into the sheet processing apparatus 2, the entrance sensor 32 becomes in an ON state as the detection result. Upon detecting that the sheet which had intruded into the sheet processing apparatus 2 has passed through the entrance roller 31, the entrance sensor 32 becomes in an OFF state as the detection result.

The tray 33 has a tray sensor 34 to detect the presence or absence of a sheet. Upon detecting that a sheet is present on the tray 33, the tray sensor 34 becomes in an ON state as the detection result. Upon detecting that a sheet is absent on the tray 33, the tray sensor 34 becomes in an OFF state as the detection result.

The storage box 39 is detachably provided inside the main body of the sheet processing apparatus 2. Accordingly, a user opens the cover of the main body of the sheet processing apparatus 2, to load the storage box 39 in the sheet processing apparatus 2, for example. In addition, a user opens the cover of the main body of the sheet processing apparatus 2, to take out the storage box 39 from the sheet processing apparatus 2, for example.

The storage box 39 has a box sensor 40 to detect the presence or absence of a sheet. Upon detecting that a sheet is present in the storage box 39, the box sensor 40 becomes in an ON state as the detection result. Upon detecting that a sheet is absent in the storage box 39, the box sensor 40 becomes in an OFF state as the detection result.

The sheet processing apparatus 2 has a second conveying mechanism 42 to convey a sheet from the storage box 39 to the erasing unit 37.

When the sheet processing apparatus 2 determines that a sheet is present on the tray 33 during an elapsed time exceeding a predetermined threshold value T1, based on the detection result of the above-described tray sensor 34 and the measurement result of the elapsed time, the sheet processing apparatus 2 conveys the sheet to the erasing unit 37 by the first conveying mechanism 36, and erases an image on the sheet by the erasing unit 37. In other words, when the sheet processing apparatus 2 determines that a sheet has been left on the tray 33 by a user during the elapsed time exceeding the above-described threshold value T1, the sheet processing apparatus 2 conveys the sheet to the erasing unit 37 by the first conveying mechanism 36, and erases an image on the sheet by the erasing unit 37. The above-described threshold value T1 may arbitrarily be set by a user.

In addition, when the storage box 39 is loaded in the sheet processing apparatus 2, in case that the sheet processing apparatus 2 determines that a sheet has been left on the tray 33 during the elapsed time exceeding the above-described threshold value T1, the sheet processing apparatus 2 conveys the sheet to the storage box 39.

The storage box 39 has a pickup unit which takes out a sheet and transfers the sheet to the second conveying mechanism 42.

When the sheet processing apparatus 2 determines that a sheet is present in the above-described storage box 39 during an elapsed time exceeding a predetermined threshold value T2, based on the detection result of the above-described box sensor 40 and the measurement result of the elapsed time, the sheet processing apparatus 2 conveys the sheet to the erasing unit 37 by the second conveying mechanism 42, and erases an image on the sheet by the erasing unit 37. In other words, when the sheet processing apparatus 2 determines that a sheet has been left in the storage box 39 by a user during the elapsed time exceeding the above-described threshold value T2, the sheet processing apparatus 2 conveys the sheet to the erasing unit 37 by the second conveying mechanism 42, and erases an image on the sheet by the erasing unit 37. The above described threshold value T2 may be the same value as the above-described threshold value T1. The above-described threshold value T2 may arbitrarily be set by a user.

The sheet discharge tray 41 is provided inside the main body of the sheet processing apparatus 2. Accordingly, a user opens the cover of the main body of the sheet processing apparatus 2, to take out a sheet from the sheet discharge tray 41, for example.

Figure 2:
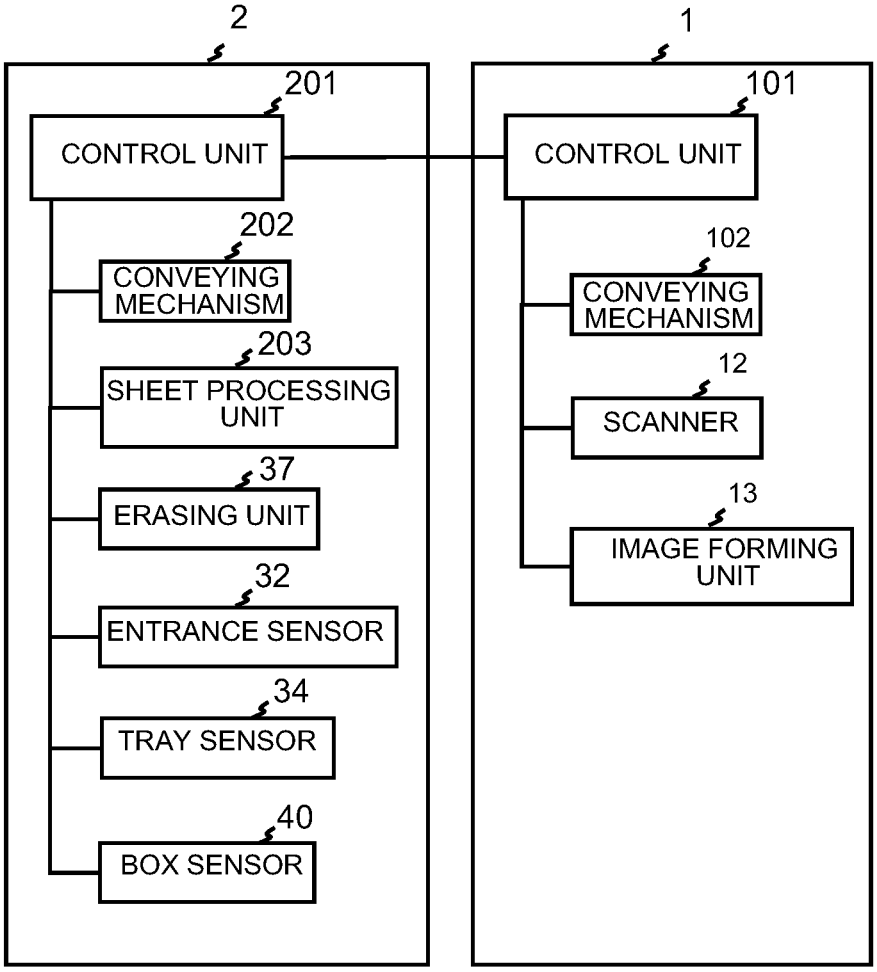
FIG. 2 is a block diagram showing a configuration of the sheet processing apparatus according to the first embodiment and the image forming apparatus.

FIG. 2 is a block diagram showing a configuration of the sheet processing apparatus 2 according to the first embodiment and the image forming apparatus 1 which is used with the sheet processing apparatus 2. As shown in FIG. 2, the image forming apparatus 1 has the control unit 101 to perform arithmetic processing, a conveying mechanism 102 to convey a sheet, the scanner 12 to read out an image from a document, and the image forming unit 13 to form an image on a sheet. The conveying mechanism 102 includes the conveying roller provided on the above-described conveying path 18, a drive motor to drive the conveying roller, and the discharge mechanism 16.

The sheet processing apparatus 2 has the control unit 201 to perform calculation, a conveying mechanism 202 to convey a sheet, and the sheet processing unit 203 to punch or staple a sheet. The conveying mechanism 202 includes the above-described first conveying mechanism 36 and second conveying mechanism 42. The sheet processing apparatus 2 further has the erasing unit 37 to erase an image of a sheet by heating the image of the sheet at not less than the erasing temperature, the entrance sensor 32, the tray sensor 34, and the box sensor 40.

Figure 3:
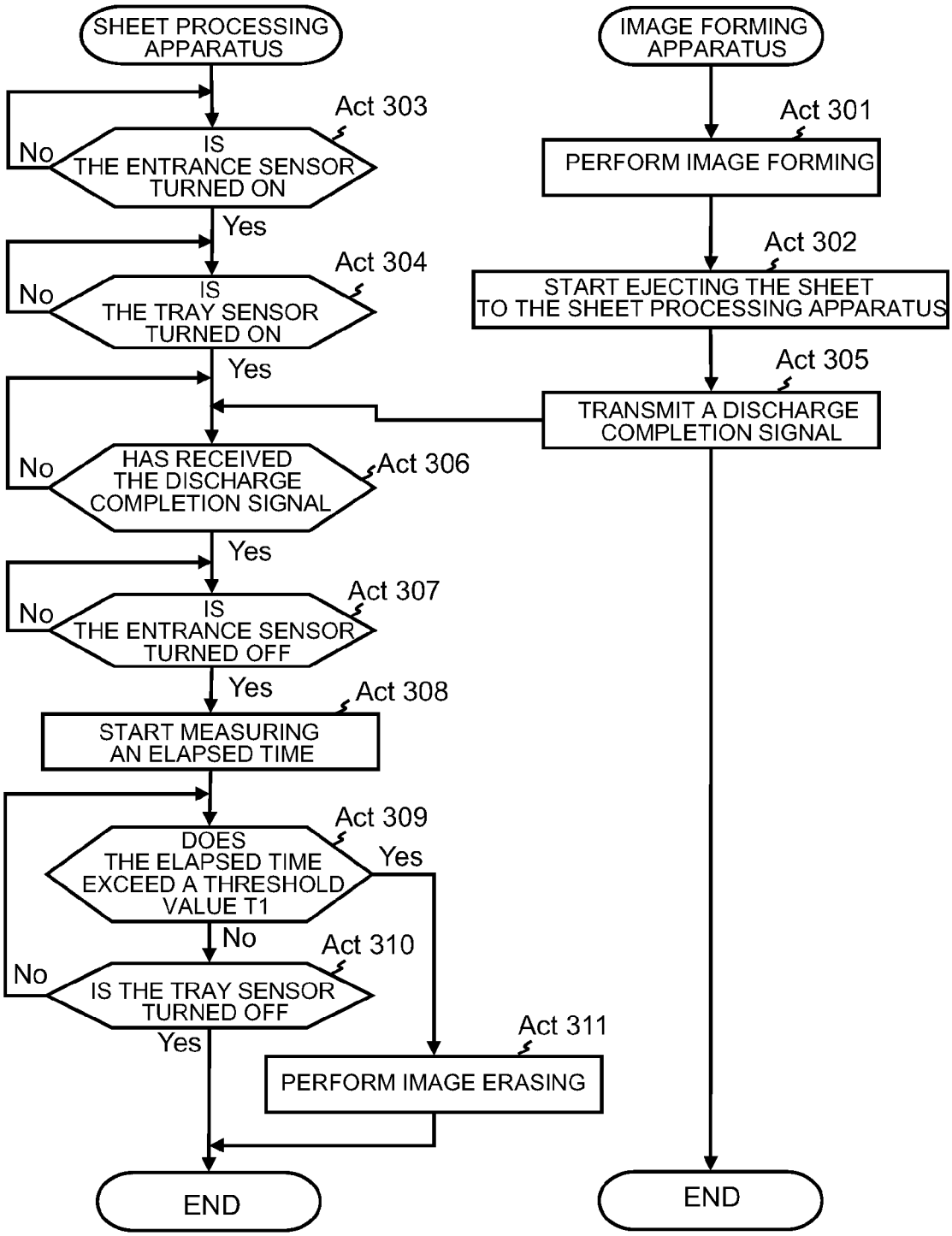
FIG. 3 is a flow chart showing an operation of the sheet processing apparatus according to the first embodiment and the image forming apparatus.

FIG. 3 is a flow chart showing an operation of the sheet processing apparatus 2 according to the first embodiment and the image forming apparatus 1. An operation of the image forming apparatus 1 and the sheet processing apparatus 2 will be described with reference to FIG. 3. As shown in FIG. 3, in an Act 301, the control unit 101 of the image forming apparatus 1 controls the configuration of the image forming unit 13 and the conveying unit 202 and so on, so that an image is formed on a sheet. The image forming unit 13 and so on are controlled, and thereby the image forming apparatus 1 forms an image on a sheet.

In an Act 302, the control unit 101 of the image forming apparatus 1 controls the conveying mechanism 102 so that the sheet is discharged to the sheet processing apparatus 2. The conveying mechanism is controlled, and thereby the image forming apparatus 1 starts ejecting the sheet to the sheet processing apparatus 2.

In an Act 303, the control unit 201 of the sheet processing apparatus 2 determines whether or not the entrance sensor 32 is in the ON state. When the control unit 201 determines that the entrance sensor 32 is in the ON state, the operation of the sheet processing apparatus 2 proceeds to an Act 304. When the control unit 201 determines that the entrance sensor 32 is not in the ON state, the operation of the sheet processing apparatus 2 returns to the above-described Act 303.

In the above-described Act 304, the control unit 201 of the sheet processing apparatus 2 determines whether or not the tray sensor 34 is in the ON state. When the control unit 201 determines that the tray sensor 34 is in the ON state, the operation of the sheet processing apparatus 2 proceeds to an Act 306. When the control unit 201 determines that the tray sensor 34 is not in the ON state, the operation of the sheet processing apparatus 2 returns to the above-described Act 304.

In an Act 305, when the sheet forming apparatus 1 finishes discharging the sheet, the control unit 101 transmits a discharge completion signal to the sheet processing apparatus 2. The discharge mechanism 16 has a sensor to detect a rear end of the sheet during conveyance, for example. The control unit 101 determines the discharge completion of the sheet by the detection result of the sensor of the discharge mechanism 16, and transmits the discharge completion signal.

In the above-described Act 306, the control unit 201 of the sheet processing apparatus 2 determines whether or not the above-described sheet discharge completion signal has been received from the image forming apparatus 1. When the control unit 201 determines that the above-described sheet discharge completion signal has been received from the image forming apparatus 1, the operation of the sheet processing apparatus 2 proceeds to an Act 307. When the control unit 201 determines that the above-described sheet discharge completion signal has not been received from the image forming apparatus 1, the operation of the sheet processing apparatus 2 returns to the above-described Act 306.

In the above-described Act 307, the control unit 201 of the sheet processing apparatus 2 determines whether or not the entrance sensor 32 is in the OFF state. When the control unit 201 determines that the entrance senor 32 is in the OFF state, the operation of the sheet processing apparatus 2 proceeds to an Act 308. When the control unit 201 determines that the entrance sensor 32 is not in the OFF state, the operation of the sheet processing apparatus 2 returns to the above-described Act 307.

In the above-described Act 308, the control unit 201 counts a clock signal for the time control, to start measuring an elapsed time.

In an Act 309, the control unit 201 of the sheet processing apparatus 2 determines whether or not the elapsed time exceeds the above-described threshold value T1. When the control unit 201 determines that the elapsed time exceeds the above-described threshold value T1, the operation of the sheet processing apparatus 2 proceeds to an Act 311. When the control unit 201 determines that the elapsed time does not exceed the above-described threshold value T1, the operation of the sheet processing apparatus 2 proceeds to an Act 310.

In the above-described Act 310, the control unit 201 of the sheet processing apparatus 2 determines whether or not the tray sensor 34 is in the OFF state. When the control unit 201 determines that the tray sensor 34 is in the OFF state, the operation of the sheet processing apparatus 2 finishes. When the control unit 201 determines that the tray sensor 34 is not in the OFF state, the operation of the sheet processing apparatus 2 returns to the above-described Act 309.

In the above-described Act 311, the sheet processing apparatus 2 conveys the sheet to the erasing unit 37, to erase the image of the sheet by the erasing unit, and finishes the operation.

Specifically, in the above-described Act 311, the control unit 201 determines whether or not the storage box 39 is loaded in the sheet processing apparatus 2. When the control unit 201 determines that the storage box 39 is not loaded in the sheet processing apparatus 2, the control unit 201 controls the conveying unit so that the sheet is conveyed to the erasing unit 37. The first conveying mechanism 36 conveys the sheet taken out from the tray 33 to the erasing unit 37. The control unit 201 controls the erasing unit 37 so that an image of the sheet is erased. The erasing unit 37 erases an image of the sheet conveyed from the tray 33. The erasing unit 37, in cooperation with the first conveying mechanism 36, conveys the sheet whose image has been erased to the discharge tray 41. The discharge tray 41 houses the sheet whose image has been erased.

In other words, when the storage box 39 is not loaded in the sheet processing apparatus 2, the sheet processing apparatus 2 erases the image of the sheet which has been left on the tray 33 by a user during the elapsed time exceeding the above-described threshold value T1, and houses the sheet whose image has been erased in the discharge tray 41 inside the main body of the sheet processing apparatus 2.

In addition, in the above-described Act 311, when the control unit 201 determines that the storage box 39 is loaded in the sheet processing apparatus 2, the control unit 201 controls the conveying unit so that the sheet is conveyed to the erasing unit 37. The first conveying mechanism 36 conveys the sheet taken out from the tray 33 to the erasing unit 37. The control unit 201 controls the erasing unit 37 so that an image of the sheet is not erased. The erasing unit 37 does not erase an image of the sheet conveyed from the tray 33, but conveys the sheet to the storage tray 39, in cooperation with the first conveying mechanism 36. The storage tray 39 houses the sheet whose image is not erased.

The control unit 201 determines whether or not the sheet is present in the storage box 39 during a time exceeding the above-described threshold value T2, based on the detection result of the box sensor 40 and the measurement result of the elapsed time. When the control unit 201 determines that the sheet is present in the storage box 39 during the elapsed time exceeding the above-described threshold value T2, the control unit 201 controls the conveying mechanism 202 so that the sheet in the storage box 39 is conveyed to the erasing unit 37. The second conveying mechanism 42 of the conveying mechanism 202 conveys the sheet taken out from the storage box 39 to the erasing unit 37. The control unit 201 controls the erasing unit 37 so that the image of the sheet is erased. The erasing unit 37 erases the image of the sheet conveyed from the storage box 39. The erasing unit 37 conveys the sheet whose image has been erased to the discharge tray 41, in cooperation with the first conveying mechanism 36. The discharge tray 41 houses the sheet whose image has been erased.

In other words, when the storage box 39 is loaded in the sheet processing apparatus 2, the sheet processing apparatus 2 once houses the sheet which has been left by a user on the tray 33 during the elapsed time exceeding the above-described threshold value T1, in the storage box 39 inside the main body of the sheet processing apparatus 2. Furthermore, the image processing apparatus 2 erases the image of the sheet which has been left in the storage box 39 by a user during the elapsed time exceeding the above-described threshold value T2, and houses the sheet whose image has been erased in the discharge tray 41 inside the main body of the sheet processing apparatus 2.

As described above, a sheet processing apparatus according to the present embodiment has a tray to house a sheet on which an image is formed, an erasing unit to erase the image formed on the sheet, and a control unit to control the erasing unit so that the image formed on the sheet is erased when an elapsed time after the tray houses the sheet exceeds a predetermined threshold value.

Accordingly, according to the embodiment, an effect is exerted which can improve the security to the leaving of a sheet on which an image is formed by an image forming apparatus.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A sheet processing apparatus, comprising:

a tray configured to house a sheet on which an image is formed;

an erasing unit configured to erase the image formed on the sheet;

a control unit configured to determine whether an elapsed time after the tray houses the sheet exceeds a predetermined first threshold value, and to control the erasing unit so that the image formed on the sheet is erased, when the control unit determines that the elapsed time exceeds the first threshold value;

a tray sensor to detect whether or not the sheet is present on the tray, wherein the control unit determines whether or not the elapsed time after the tray houses the sheet exceeds the first threshold value, based on a detection result by the tray sensor indicating that the sheet is present on the tray; and an entrance sensor to detect that the sheet enters an entrance of the apparatus, wherein the control unit measures the elapsed time after the tray houses the sheet, and determines whether or not the measured elapsed time exceeds the first threshold value, based on a detection result by the entrance sensor indicating that the sheet finishes entering, and the detection result by the tray sensor.

2. The sheet processing apparatus according to claim 1, further comprising: a sheet processing unit to perform at least one processing out of a punch processing and a staple processing to the sheet whose image has been erased by the erasing unit.

* * * * *